US009960550B2

(12) United States Patent
Ensley et al.

(10) Patent No.: US 9,960,550 B2
(45) Date of Patent: May 1, 2018

(54) COAXIAL CONNECTOR ASSEMBLY

(71) Applicant: DELPHI TECHNOLOGIES, INC., Troy, MI (US)

(72) Inventors: Cory R. Ensley, Canfield, OH (US); John R. Morello, Warren, OH (US); Michael Jerry Demonica, Cortland, OH (US); Matthew L. Penn, Cortland, OH (US); James M. Rainey, Warren, OH (US); Geronimo Mauricio De La Torre, Warren, OH (US); Crystal F. Krompegel, Canfield, OH (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 0 days. days.

(21) Appl. No.: 15/218,128

(22) Filed: Jul. 25, 2016

(65) Prior Publication Data

US 2018/0026408 A1 Jan. 25, 2018

(51) Int. Cl.
*H01R 24/38* (2011.01)
*H01R 13/506* (2006.01)
*H01R 13/631* (2006.01)

(52) U.S. Cl.
CPC ..... *H01R 24/38* (2013.01); *H01R 13/506* (2013.01); *H01R 13/631* (2013.01)

(58) Field of Classification Search
CPC ..... H01R 24/38; H01R 13/506; H01R 13/631
USPC ..... 439/578, 582, 585, 654, 845, 535, 527
See application file for complete search history.

(56) References Cited

U.S. PATENT DOCUMENTS 6,149,448 A * 11/2000 Haller ..... H01R 13/641 439/188
6,655,987 B2 * 12/2003 Higashikozono .... H01R 9/2425 439/535
6,964,579 B2 * 11/2005 Seminara ..... F42B 3/26 439/188
7,291,036 B1 * 11/2007 Daily ..... H05K 7/20445 439/487
7,335,065 B1 * 2/2008 Chen ..... H01R 13/6272 439/654
7,794,274 B2 * 9/2010 Phillips, Jr. ..... H01R 13/187 439/578

(Continued)

FOREIGN PATENT DOCUMENTS

CN 103199356 A 7/2013
DE 102010028802 A1 11/2011

*Primary Examiner* — Alexander Gilman
(74) *Attorney, Agent, or Firm* — Robert J. Myers

(57) ABSTRACT

A coaxial connector assembly is described herein. The coaxial connector assembly includes an inner contact that is configured to terminate a center conductor of a coaxial cable, an insulative inner sleeve holding the inner contact, a tubular outer contact surrounding the inner sleeve and the inner contact, said outer contact configured to terminate a shield braid of the coaxial cable and an insulative cylindrical outer sleeve defining a central cavity extending longitudinally therethrough in which said outer contact is disposed. The cavity has an opening configured to receive a corresponding coaxial connector. A lip on a forward end of the outer sleeve extends into the opening such that a forward edge of the outer contact is not exposed within the opening. The coaxial connector assembly may be configured to meet the FAKRA connector standards.

4 Claims, 8 Drawing Sheets

(56) References Cited

U.S. PATENT DOCUMENTS 7,833,033 B2 * 11/2010 McMahon ..... H02S 40/34 439/212
7,927,132 B1 * 4/2011 Lin ..... H01R 4/4809 439/527
7,980,894 B1 * 7/2011 Hall ..... H01R 9/053 439/585
8,137,115 B1 * 3/2012 Chou ..... H01R 9/24 136/244
8,182,285 B2 * 5/2012 Annequin ..... H01R 24/54 439/582
8,251,762 B2 * 8/2012 Maier ..... H01R 13/64 439/521
8,287,300 B2 * 10/2012 Yamazaki ..... H02S 40/34 439/441
8,303,349 B2 * 11/2012 Shmukler ..... H01R 13/2435 439/724
8,353,725 B2 * 1/2013 Ebihara ..... H01R 4/185 439/626
8,491,333 B2 * 7/2013 Evans ..... H01R 9/05 439/345
8,647,160 B2 * 2/2014 Umemoto ..... H01R 13/113 439/845
8,895,852 B2 * 11/2014 Sella ..... H02G 3/083 174/50
8,901,731 B2 * 12/2014 Yamazaki ..... H01L 23/32 257/698
8,905,783 B2 * 12/2014 Umemoto ..... H01R 33/965 439/274
9,537,231 B2 * 1/2017 Hall ..... H01R 9/0518
2010/0304598 A1 12/2010 Kari
2011/0008999 A1 1/2011 Annequin et al.
2012/0202372 A1 * 8/2012 Hardy ..... H01R 9/0518 439/460
2013/0157505 A1 6/2013 Sykes et al.
2015/0244115 A1 * 8/2015 Yamaguchi ..... H01R 13/6581 439/580
2016/0164232 A1 6/2016 Lane et al.

* cited by examiner

COAXIAL CONNECTOR ASSEMBLY

TECHNICAL FIELD OF THE INVENTION

The present invention relates generally to electrical connectors and, more particularly, to a female coaxial connector assembly.

BACKGROUND OF THE INVENTION

Coaxial cable connector assemblies have been used for numerous automotive applications, such as global positioning systems (GPS), infotainment systems, and air bag systems. Coaxial cables typically consist of an outer shield conductor, an inner center conductor, a dielectric, and an insulation jacket. The outer conductor and the inner conductor of the coaxial cable often electrically interface with a mating coaxial cable through socket and plug connectors. Such conventional coaxial cable connectors are known in the art.

In order to standardize various types of connectors and thereby avoid confusion, certain industry standards have been established. One of these standards is referred to as FAKRA. FAKRA is the Automotive Standards Committee in the German Institute for Standardization (in German "Deutsches Institut für Normung", best known by the acronym DIN), representing international standardization interests in the automotive field. The FAKRA standard provides a system, based on keying and color coding, for proper connector attachment. Like socket keys can only be connected to like plug keyways in FAKRA connectors. Secure positioning and locking of connector housings is facilitated by way of a FAKRA defined catch on the socket housing and a cooperating latch on the plug housing.

The connector assemblies include an inner contact and an outer contact that provides shielding for the inner contact. The outer contact is typically manufactured from a zinc die-cast or screw machined part, which is expensive to manufacture.

A need remains for a connector assembly that may be manufactured in a cost effective and reliable manner. Additionally, a need remains for a connector assembly that may utilize less expensive parts, such as stamped and formed parts, in existing outer housings and locks made for die-cast parts.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, a coaxial connector assembly is provided. The coaxial connector assembly includes an inner contact that is configured to terminate a center conductor of a coaxial cable, an insulative inner sleeve that holds the inner contact within it and a tubular outer contact that surrounds the inner sleeve and the inner contact. The outer contact is configured to terminate a shield braid of the coaxial cable. The coaxial connector assembly further includes an insulative cylindrical outer sleeve defining a central cavity that extends longitudinally therethrough. The outer contact is disposed within this cavity. The cavity has an opening that is configured to receive a corresponding coaxial connector. A lip on a forward end of the outer sleeve extends into the opening such that a forward edge of the outer contact is not exposed within the opening. This lip may be angled inwardly toward the opening.

The outer contact may define a lock tab that radially protrudes from an outer surface of the outer contact and the outer sleeve may also define an aperture that extends radially from the cavity to the outer surface of the outer sleeve in which this lock tab is received.

Alternatively, the outer contact may define a pair of lock tabs. Each lock tab of this pair of lock tabs protrudes from opposite sides of an outer surface of the outer contact. The outer sleeve may also define a pair of apertures. Each aperture of the pair of apertures extends radially from the cavity to the outer surface through opposite sides of the outer sleeve in which one of the pair of lock tabs is received.

The cavity may define a pair of longitudinal slots. Each slot of the pair of slots extends radially through opposite sides of the outer sleeve and each slot is intermediate the pair of apertures. The pair of slots is configured to allow sides of the outer sleeve to flex outwardly.

The coaxial connector assembly may further include a connector housing in which the outer sleeve is received. The connector housing inhibits the sides of the outer sleeve from flexing outwardly.

In accordance with another embodiment of the invention, a female coaxial connector assembly is provided. The female coaxial connector assembly includes an inner contact that is configured to terminate a center conductor of a coaxial cable, an inner sleeve formed of a first dielectric material and holding the inner contact, and a tubular outer contact that is formed from a flat work piece. The outer contact surrounds the inner sleeve and the inner contact. The outer contact is configured to terminate a shield braid of the coaxial cable. The female coaxial connector assembly also includes a cylindrical outer sleeve that is formed of a second dielectric material. The outer sleeve defines a longitudinal cavity that extends therethrough. The outer contact is disposed within this cavity. The cavity has an opening that is configured to receive a corresponding male coaxial connector. A lip on a forward end of the outer sleeve is angled inwardly toward the opening and extends into the opening such that a forward edge of the outer contact is not exposed within the opening.

A lock tab may be formed in the flat work piece. The lock tab radially protrudes from the outer contact. The outer sleeve may also define an aperture that extends radially from the cavity to the outer surface of the outer sleeve in which this lock tab is received.

Alternatively, a pair of lock tabs may be formed in the flat work piece. Each lock tab of the pair of lock tabs protrudes from opposite sides of the outer contact. The outer sleeve may also define a pair of apertures. Each aperture of the pair of apertures extends radially from the cavity to the outer surface through opposite sides of the outer sleeve in which one of the pair of lock tabs is received. A rearward edge of the lock tab engages a forward edge of the aperture, thereby inhibiting removal of the outer contact from the outer sleeve.

The outer sleeve may define a pair of slots that extend longitudinally from a rearward flange of the outer sleeve. Each slot of the pair of slots extends radially through opposite sides of the outer sleeve. Each slot is located intermediate the pair of apertures. The pair of slots is configured to allow sides of the outer sleeve to flex outwardly when a forward surface of the lock tabs engages the rearward flange of the outer sleeve.

The female coaxial connector may further include a connector housing in which the outer sleeve is received. The connector housing inhibits the sides of the outer sleeve from flexing outwardly, thereby retaining the pair of lock tabs within the pair of apertures.

BRIEF DESCRIPTION OF THE SEVERAL VIEWS OF THE DRAWING

The present invention will now be described, by way of example with reference to the accompanying drawings, in which:

FIG. 8A is an alternative perspective view of the coaxial connector assembly of FIG. 1 according to one embodiment; and.

FIG. 8B is cross sectional view of the coaxial connector assembly of FIG. 8A according to one embodiment; and.

DETAILED DESCRIPTION OF THE INVENTION

Presented herein is a description of a coaxial connector assembly configured to terminate a shielded coaxial cable and suitable for use in automotive applications.

Figure 1:
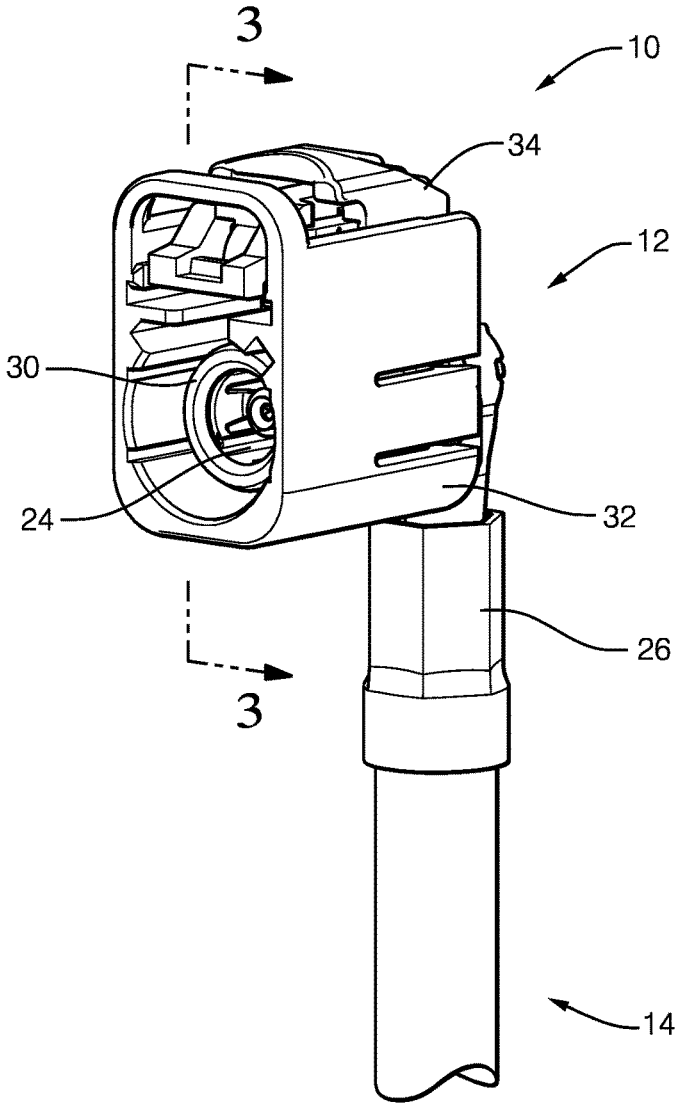
FIG. 1 is a perspective view of a coaxial connector assembly according to one embodiment.
Figure 2:
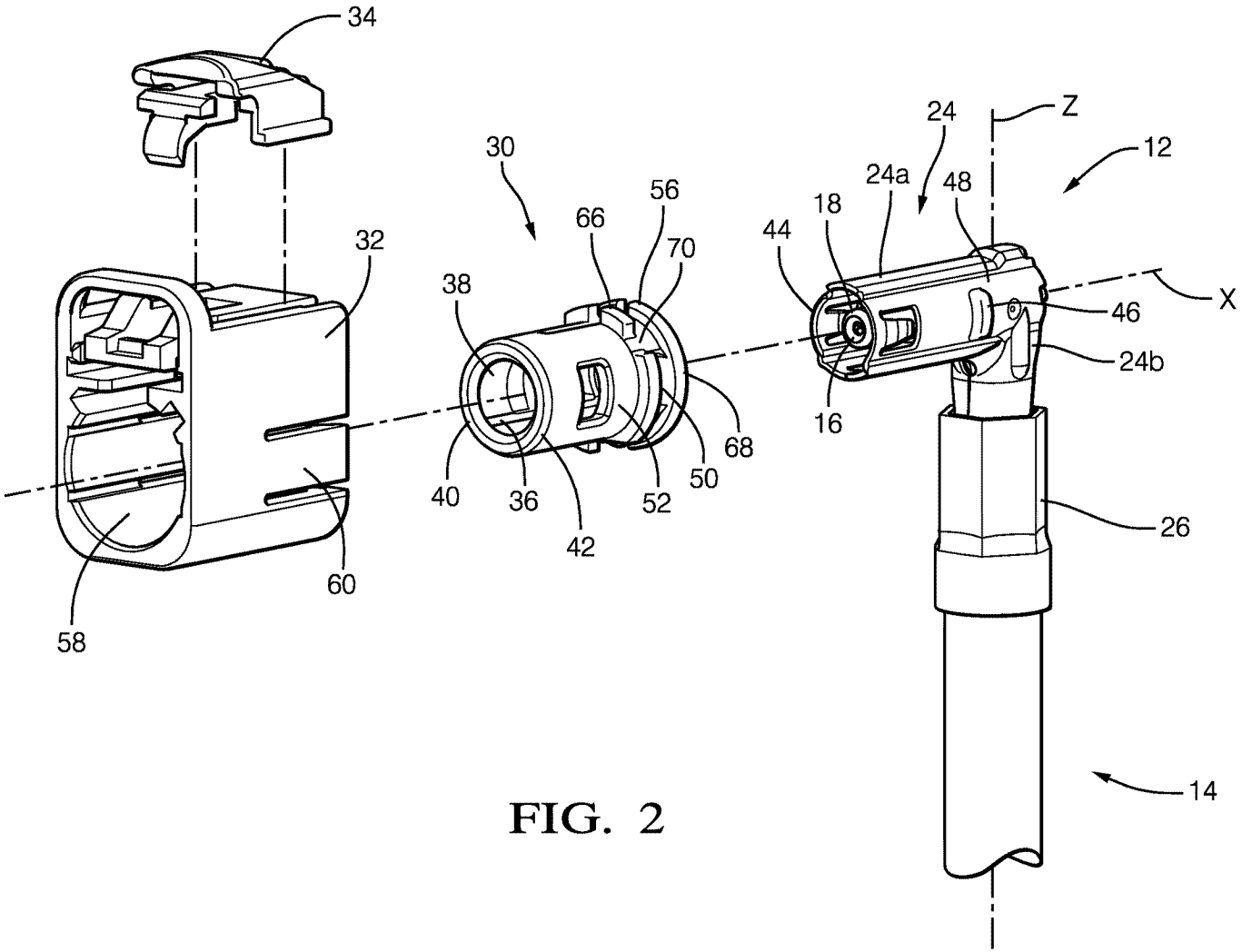
FIG. 2 is an exploded perspective view of the coaxial connector assembly of FIG. 1 according to one embodiment.
Figure 3:
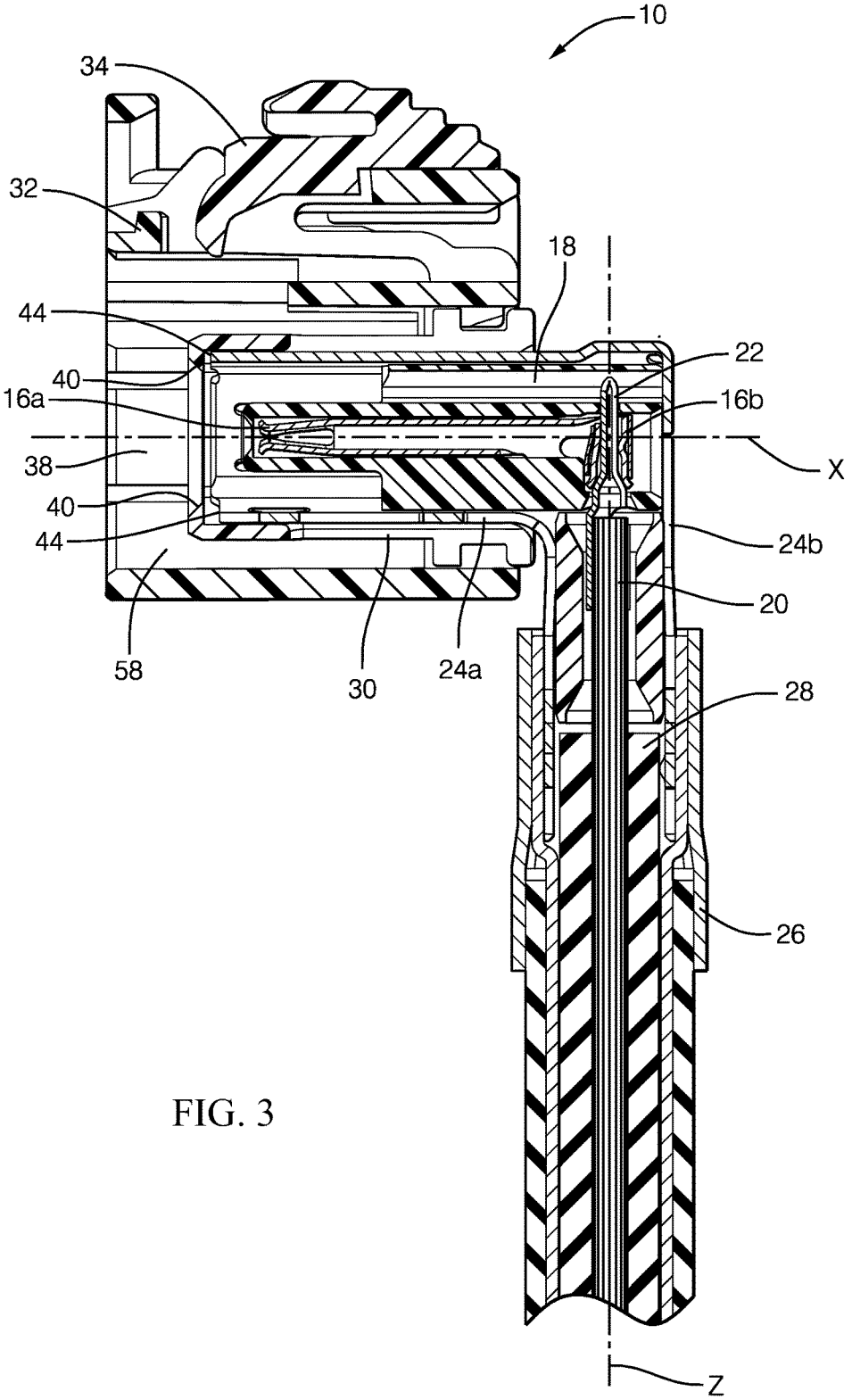
FIG. 3 is cross sectional side view of the coaxial connector assembly of FIG. 1 according to one embodiment.

FIGS. 1-3 illustrate a non-limiting example of a right angled female coaxial connector assembly, hereinafter referred to as the assembly 10. The assembly 10 includes a right angled female coaxial connector, hereinafter referred to as the coaxial connector 12 that is attached to a coaxial cable 14. The female coaxial connector includes an inner contact 16 contained within an insulative inner sleeve 18. The inner contact 16 is configured to terminate a center conductor 20 of the coaxial cable 14 and provide contact with an inner contact (not shown) of a corresponding mating male coaxial connector assembly (not shown). The inner contact 16 may be formed from an electrically conductive material such as bronze and may be plated, e.g. with nickel, tin, or gold depending on the area of the inner contact 16. The inner contact 16 is formed from a single work piece that is stamped and rolled into a generally tubular shape. One end of the inner contact 16 defines a first female socket 16*a* that is configured to receive the male pin inner contact of the corresponding mating male coaxial connector assembly. The other end of the inner contact 16 defines a second socket 16*b* that is generally oriented ninety degrees relative to the first socket 16*a*. The second socket 16*b* is configured to receive a male pin terminal 22 attached to the center conductor 20 of the coaxial cable 14. Other embodiments may omit the male pin terminal and the center conductor 20 of the coaxial cable 14 may be received directly into the second socket 16*b*.

The coaxial connector 12 also includes an outer contact 24 that is configured to hold the inner contact 16 and inner sleeve 18. The outer contact 24 is formed from a flat sheet of electrically conductive material (not shown) and folded into first and second barrel sections 24*a*, 24*b* that are substantially oriented at right angles to one another. The outer contact 24 is also formed from a sheet of an electrically conductive material and also may be plated. The first barrel section 24*a* extending longitudinally (e.g. along an X axis) is configured to receive the inner sleeve 18 containing the inner contact 16. The second barrel section 24*b* extending vertically (e.g. along a Z axis) is configured to receive the coaxial cable 14 and attach to the shield conductor 28 of the coaxial cable 14 by a tubular ferrule 26 crimped to the outer contact 24. The outer contact 24 is formed of an electrically conductive material to provide electrical continuity between the shield conductor 28 of the coaxial cable 14 and an outer contact (not shown) of the corresponding mating male coaxial connector assembly.

The outer contact 24 is held within an insulative outer sleeve 30 that snaps into a connector housing 32. This connector housing 32 is configured to receive a corresponding connector housing of the mating male coaxial connector assembly. The connector housing 32 further includes a connector position assurance (CPA) device 34. This assembly 10 may conforming with the FAKRA standard.

FAKRA connectors are radio frequency (RF) connectors that have an interface that complies with the standard for a uniform connector system established by the FAKRA automobile expert group. The FAKRA connectors have a standardized keying system and locking system that fulfill the high functional and safety requirements of automotive applications. The FAKRA connectors are based on a subminiature version B connector (SMB connector) and feature snap on coupling. FAKRA connectors are designed to provide either 50 Ohm or 75 ohm impedance. The coaxial connector 12 may utilize other types of connectors other than the FAKRA connectors described herein.

As shown in FIGS. 2 and 3, the outer sleeve 30 defines a central sleeve cavity 36 that extends longitudinally (i.e. along the X axis) through the outer sleeve 30 in which the coaxial connector 12 is disposed. This sleeve cavity 36 has an opening 38 through which the corresponding mating male coaxial connector is received. As best shown in FIG. 3, a lip 40 on a forward end 42 of the outer sleeve 30 extends into the opening 38 such that a forward edge 44 of the outer contact 24 is covered by the lip 40 and is not exposed within the opening 38. As used herein, forward and rearward are referenced based on the direction of insertion of the coaxial connectors one into the other. The lip 40 is angled inwardly toward the opening 38. This lip 40 guides the outer contact of the corresponding male coaxial connector into the interior of the outer contact 24 of the coaxial connector 12 and provides protection for forward edge 44 of the outer contact 24 from stubbing with a forward edge of the outer contact of the corresponding male coaxial connector as the male and female coaxial connectors are mated.

Figure 4:
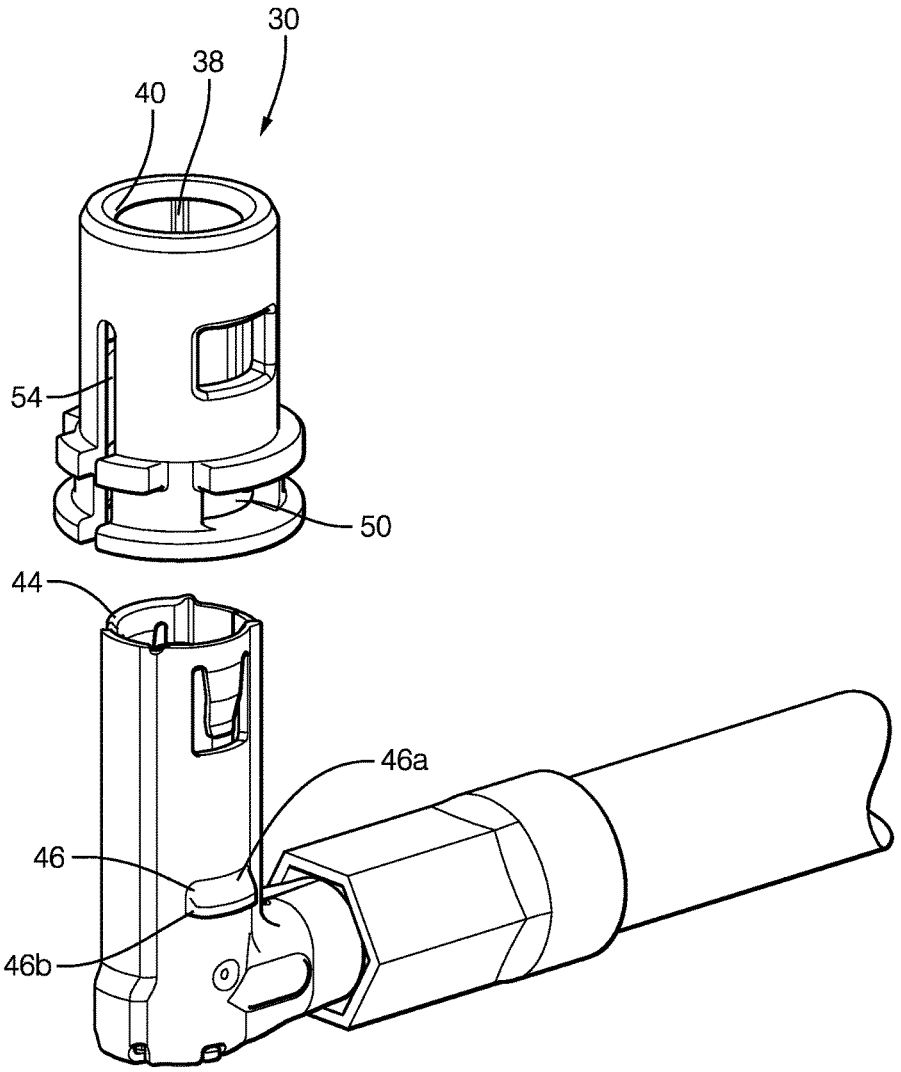
FIG. 4 is perspective view of an outer sleeve and coaxial connector of the coaxial connector assembly of FIG. 1 according to one embodiment.
Figure 5:
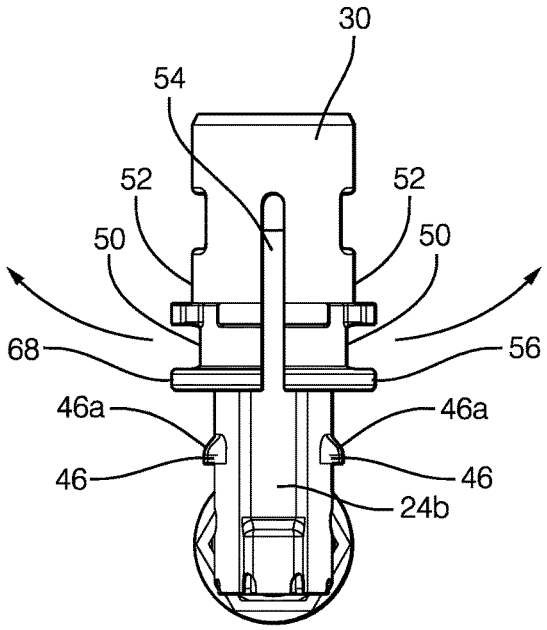
FIG. 5 is an assembly process view of the outer sleeve and coaxial connector according to one embodiment.
Figure 6:
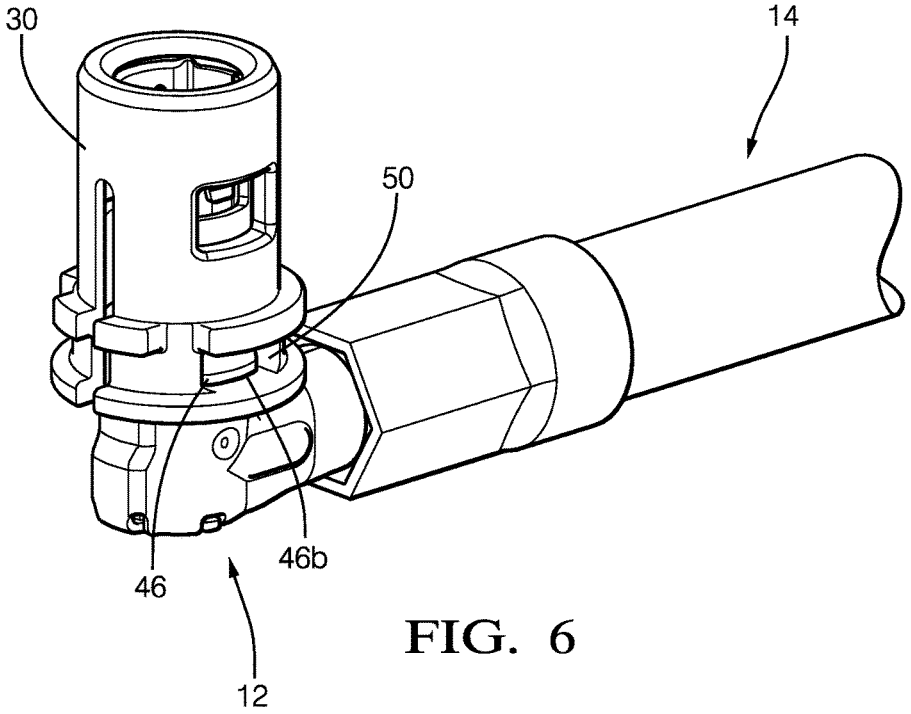
FIG. 6 is an perspective view of the outer sleeve assembled with the coaxial connector according to one embodiment.

FIGS. 4-6 illustrate the processes of assembling the outer sleeve 30 to the coaxial connector 12. As shown in FIG. 4, the outer contact 24 defines a pair of lock tabs 46 that are formed in the outer contact 24 by an embossing process. Alternatively, the lock tabs 46 may be formed by cutting tabs in the side of the outer contact 24 and bending them outward. Each lock tab 46 protrudes from opposite sides of an outer surface 48 of the outer contact 24. A forward surface 46*a* of each lock tab 46 defines an acute angle relative to the outer surface 48 of the outer contact 24. A rearward edge 46*b* of each lock tab 46 defines surfaces that are substantially perpendicular to and concentric with the outer surface 48 of the outer contact 24.

As further shown in FIG. 4, the outer sleeve 30 defines a pair of apertures 50 in the side walls 52 of the outer sleeve 30. Each aperture 50 extends radially from the sleeve cavity 36 through side walls 52 of the outer sleeve 30, one opposite the other. One of the lock tabs 46 is received in each of the apertures 50. The outer sleeve 30 also defines a pair of slots 54 extending longitudinally (i.e. along the X axis) from the rearward end 56 of the sleeve. The slots 54 do not extend to the forward end 42 of the outer sleeve 30. Each of the slots 54 extends radially from the sleeve cavity 36 through side walls 52 of the outer sleeve 30, one opposite the other. Each slot 54 is located intermediate the pair of apertures 50. As shown in FIG. 5, as the coaxial connector 12 is inserted within the outer sleeve 30, the angled forward surfaces of the lock tabs 46 contact a rearward end 56 of the outer sleeve 30 and exert an outwardly directed force on the outer sleeve 30. The slots 54 are configured to allow side walls 52 of the outer sleeve 30 to flex outwardly allowing the lock tab 46 to slide past the rearward end 56 and enter the aperture 50. When the rearward edge 46*b* of the lock tabs 46 enter the aperture 50, the side walls 52 of the outer sleeve 30 flex inwardly to their original position and the engagement of the rearward edge 46*b* of the lock tabs 46 with the outer sleeve 30, as shown in FIG. 6, inhibit removal of the coaxial connector 12 form the outer sleeve 30.

Figure 7:
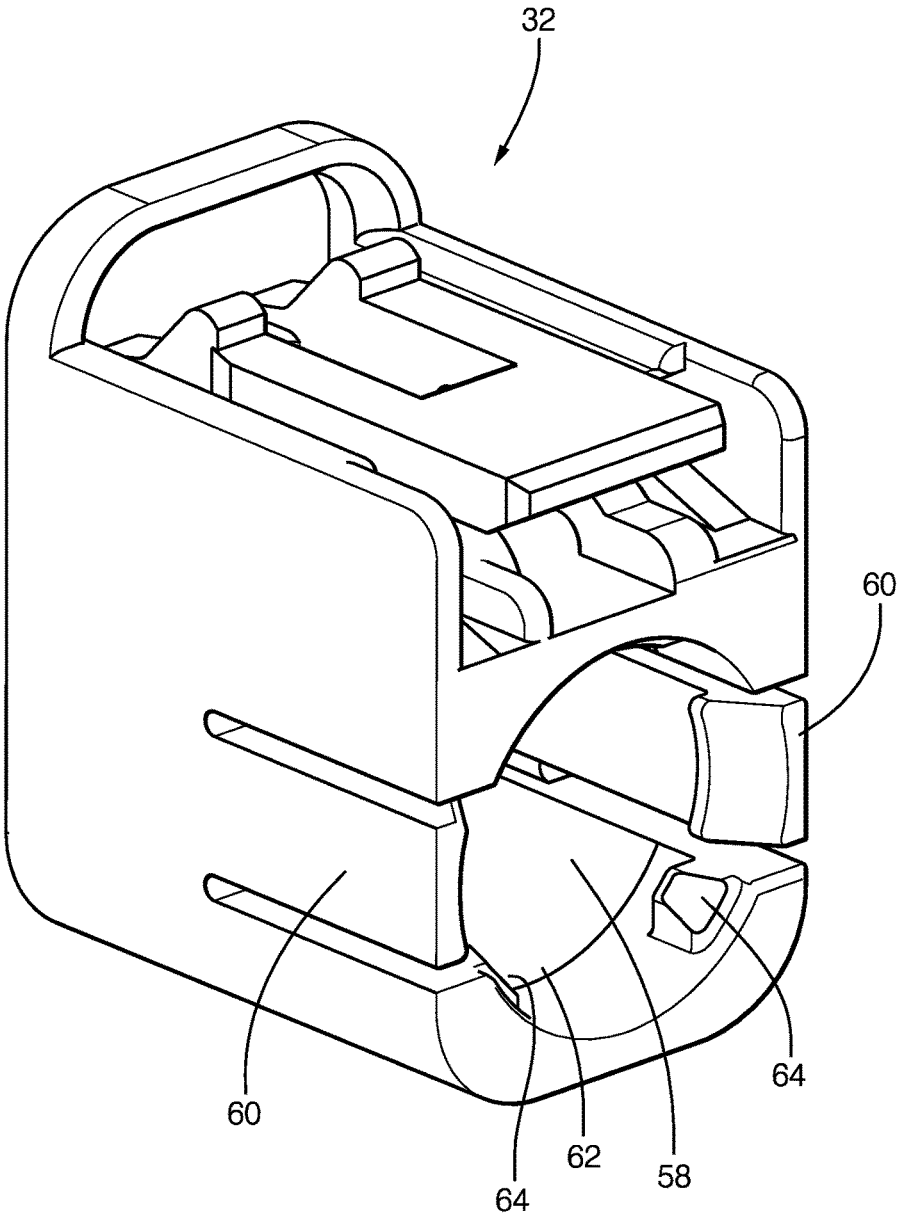
FIG. 7 is perspective view of a connector housing of the coaxial connector assembly of FIG. 1 according to one embodiment.
Figure 8B:
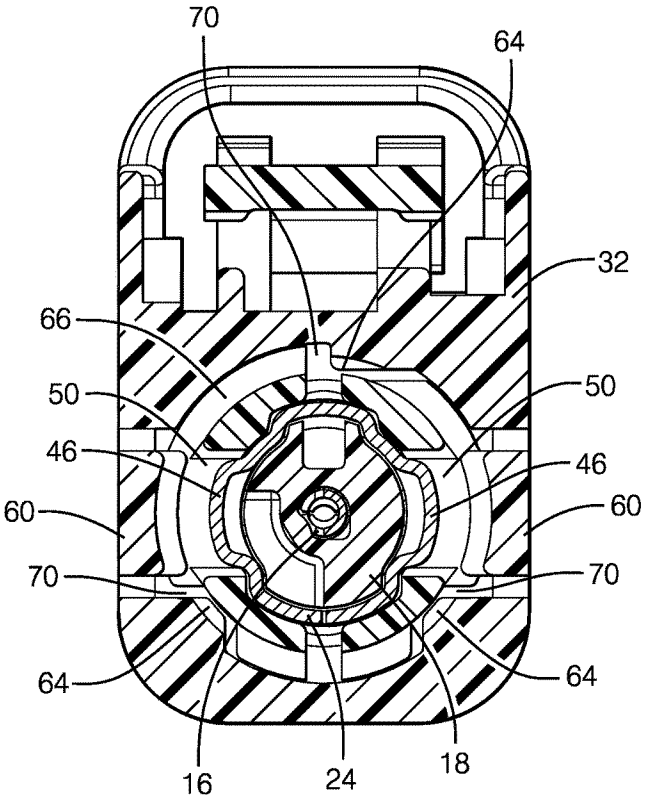

The connector housing 32 is illustrated in detail in FIGS. 7-8B. As shown in the figures, the connector housing 32 extends along the longitudinal (i.e. X axis). The connector housing 32 is made of a dielectric, preferably polymeric, material. The connector housing 32 defines a housing cavity 58 (see FIG. 7) that is configured to receive the outer sleeve 30. As further illustrated in FIG. 7, the connector housing 32 includes two elastic primary locking arms 60 arranged in the side walls 52 one opposed to the other at one of the longitudinal ends of the connector housing 32. While the example shown here has two locking arms 60, other embodiments may be envisioned having more or fewer locking arms.

As illustrated in FIG. 7, the inner surface 62 of the housing cavity 58 may define one or more rigid nibs 64 that serve as secondary locking features. The nibs 64 may or may not be arranged uniformly around the periphery of the housing cavity 58. The nibs 64 in the illustrated example are arranged in the vicinity of or at the same longitudinal end of the connector housing 32 as the primary locking arms 60.

Referring once again to FIG. 6, the outer sleeve 30 defines an interrupted forward split flange 66 located forward of the apertures 50 and a rearward split flange 68 located rearward of the apertures 50.

Figure 8A:
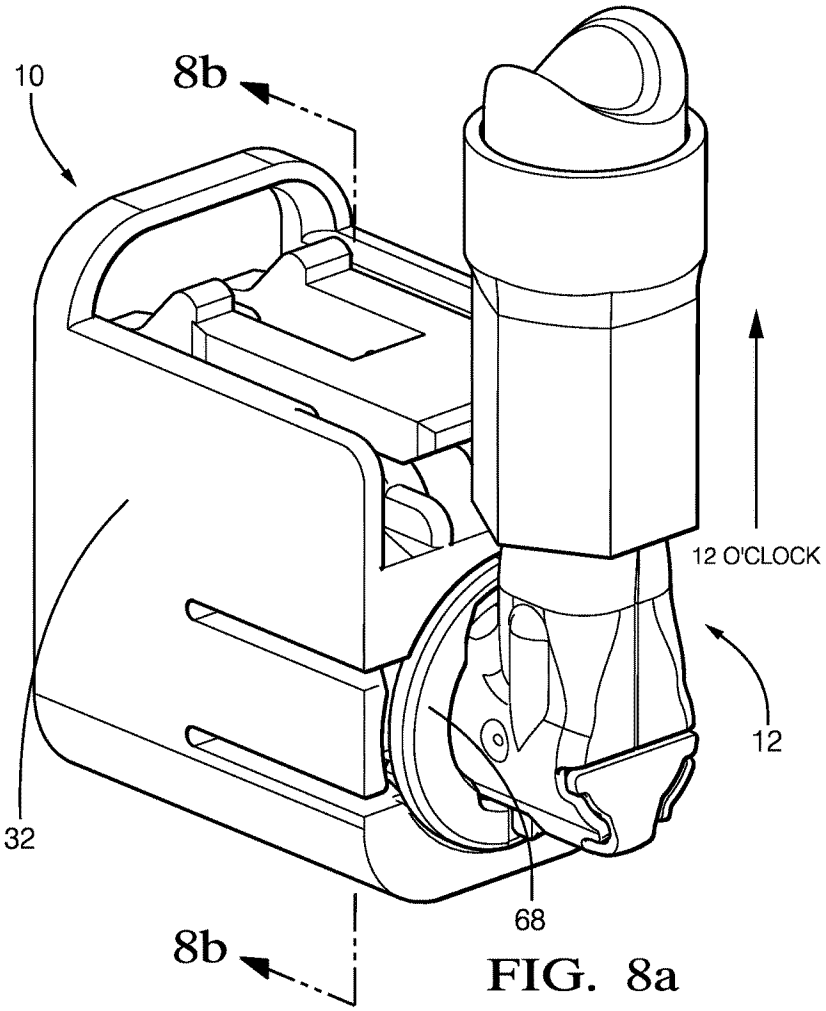
Figure 9C:
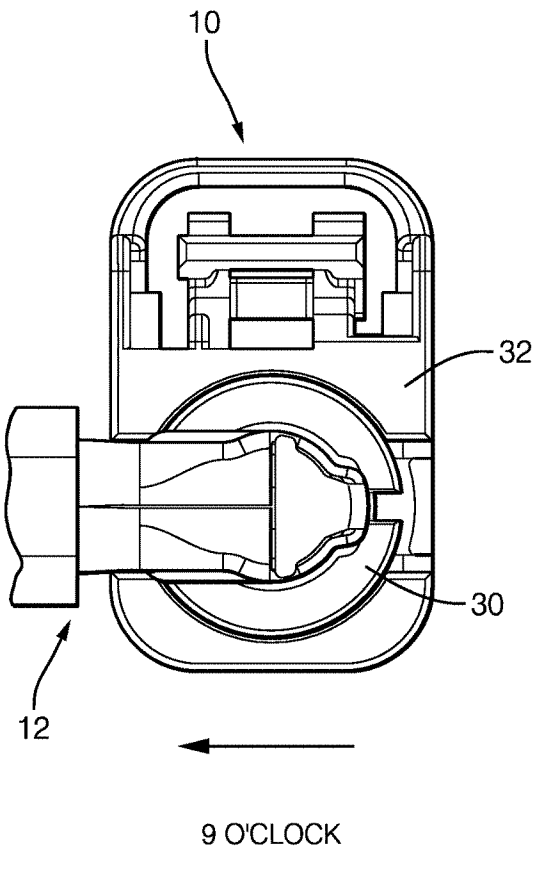
FIG. 9A-9C are rear views of the coaxial connector assembly of FIG. 1 with the coaxial connector in alternative orientations relative to the connector housing according to one embodiment.
Figure 9B:
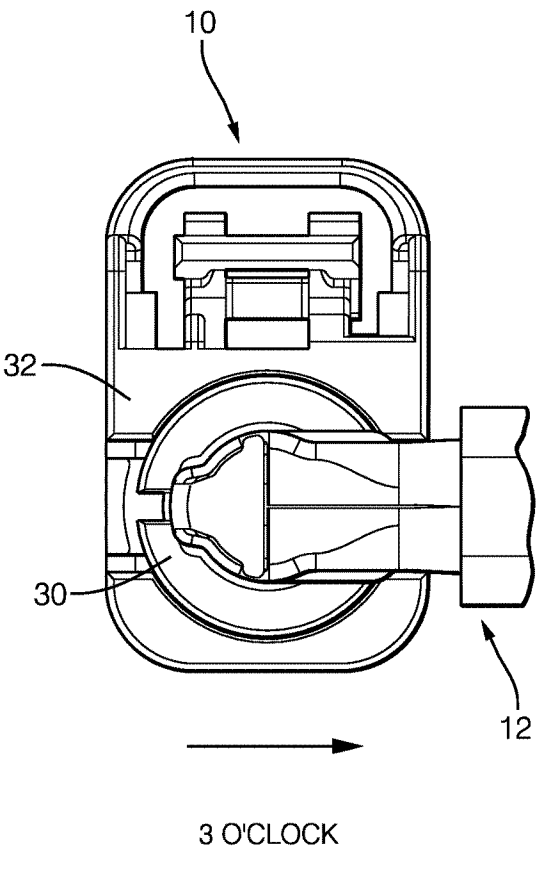
Figure 9A:
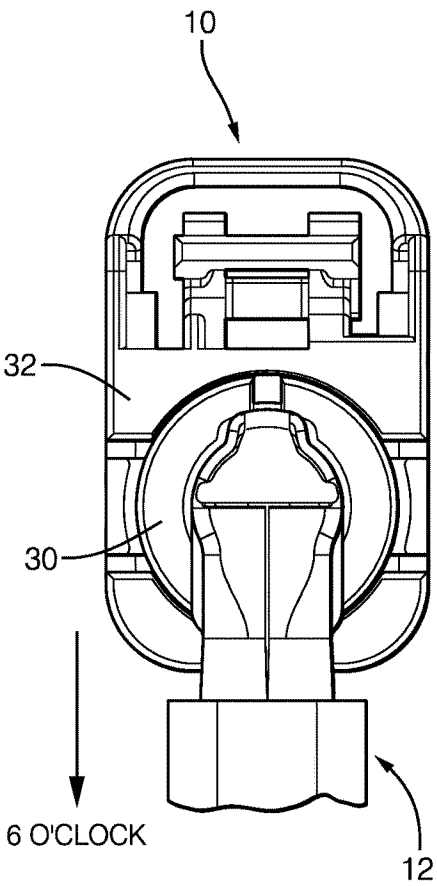

As illustrated in FIGS. 8A and 8B, the outer sleeve 30 with the coaxial connector 12 and coaxial cable 14 is inserted into the housing cavity 58. As shown in FIG. 8B, the coaxial connector 12 and coaxial cable 14 is in the 12 o'clock position. In this orientation, the nibs 64 are able to pass through the interruptions 70 in the forward flange 66. Once fully inserted into the housing cavity 58, the side walls 52 of the outer sleeve 30 is in near contact with the inner surface 62 of the housing cavity 58, inhibiting outward movement of the outer sleeve 30 and securing the lock tabs 46 within the apertures 50. The primary locking arms 60 also engage the forward flange 66 inhibiting removal of the outer sleeve 30 from the housing cavity 58. Once the outer sleeve 30 is fully inserted into the housing cavity 58, the user may rotate the outer sleeve 30 as shown in FIGS. 9A-9C. When the coaxial connector 12 and coaxial cable 14 is rotated from the 12 o'clock position to another position, such as 3 o'clock, 6 o'clock or 9 o'clock, the nibs 64 engage the forward flange 66 also inhibiting removal of the outer sleeve 30 from the housing cavity 58. The rearward flange 68 is the same size as the forward flange 66. The rearward flange stops on the rear of the nibs 64 to provide the proper location. Both outside circumferential surfaces of the flanges interact with the inner surface 62 of the housing cavity 58 to limit the movement/wobble of the outer sleeve 30 with respect to the housing 32. The rearward flange 68 contacts the connector housing 32 as the outer sleeve 30 is inserted within the housing cavity 58 and provides proper location of the outer sleeve 30 within the housing cavity 58.

While the assembly 10 in the illustrated example is a right angle or 90° configuration between the coaxial cable 14 and the outer and inner contacts, other embodiments may be envisioned in which the coaxial connector is in a straight or 180° configuration or is in any other angular confirmation.

Further, while the assembly 10 shown herein is referred to as a female coaxial connector assembly because it includes a female socket inner contact 16, other embodiments may be envisioned in which the assembly 10 includes a male pin inner contact.

Accordingly, a coaxial connector assembly 10 is provided. The assembly 10 includes an outer sleeve 30 that holds a coaxial connector 12 within a connector housing 32. This outer sleeve 30 has a lip 40 at the forward end 42 that guides an outer contact of a mating coaxial connector into the outer contact 24 of the coaxial connector 12. The lip 40 also covers the forward edge 44 of the outer contact 24 of the coaxial connector 12 which prevents stubbing (i.e. butting contact) of the outer contacts as they are mated. The connector housing 32 also includes primary and secondary locking features to secure the outer sleeve 30 holding the coaxial connector 12 within the connector housing 32. This assembly 10 may be configured to meet the FAKRA connector standards.

While this invention has been described in terms of the preferred embodiments thereof, it is not intended to be so limited, but rather only to the extent set forth in the claims that follow. Moreover, the use of the terms first, second, primary secondary, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A coaxial connector assembly, comprising:

an inner contact configured to terminate a center conductor of a coaxial cable;

an insulative inner sleeve holding the inner contact;

a tubular outer contact surrounding the inner sleeve and the inner contact, said outer contact configured to terminate a shield braid of the coaxial cable, wherein the outer contact defines a pair of lock tabs, each lock tab of the pair of lock tabs protruding from opposite sides of an outer surface of the outer contact;

an insulative cylindrical outer sleeve defining a central cavity extending longitudinally therethrough in which said outer contact is disposed, wherein said cavity has an opening configured to receive a corresponding coaxial connector and wherein a lip on a forward end of the outer sleeve extends into the opening such that a forward edge of the outer contact is not exposed within the opening, wherein the outer sleeve defines a pair of apertures, each aperture of the pair of apertures extending radially from the cavity to the outer surface through opposite sides of the outer sleeve in which one of the pair of lock tabs is received and wherein the outer sleeve defines a pair of longitudinal slots, each slot of the pair of slots extending radially through opposite sides of the outer sleeve and each slot intermediate the pair of apertures, said pair of slots configured to allow sides of the outer sleeve to flex outwardly; and a connector housing in which the outer sleeve is received and wherein the connector housing inhibits the sides of the outer sleeve from flexing outwardly.

2. The coaxial connector assembly according to claim 1, wherein the lip is angled inwardly toward the opening.

3. A female coaxial connector assembly, comprising:

an inner contact configured to terminate a center conductor of a coaxial cable;

an inner sleeve formed of a first dielectric material and holding the inner contact;

a tubular outer contact formed from a flat work piece and surrounding the inner sleeve and the inner contact, said outer contact configured to terminate a shield braid of the coaxial cable; and a cylindrical outer sleeve formed of a second dielectric material and defining a longitudinal cavity extending therethrough, wherein said outer contact is disposed within said cavity, wherein said cavity has an opening configured to receive a corresponding male coaxial connector, and wherein a lip on a forward end of the outer sleeve angled inwardly toward the opening and extending into the opening such that a forward edge of the outer contact is not exposed within the opening, wherein a pair of lock tabs is formed from the flat work piece, each lock tab of the pair of lock tabs protruding from opposite sides of the outer contact, wherein the outer sleeve defines a pair of apertures, each aperture of the pair of apertures extending radially from the cavity to the outer surface through opposite sides of the outer sleeve in which one of the pair of lock tabs is received, and wherein a rearward edge of the lock tab engages a forward edge of the aperture, thereby inhibiting removal of the outer contact from the outer sleeve, and wherein the outer sleeve defines a pair slots extending longitudinally from a rearward flange of the outer sleeve, each slot of the pair of slots extending radially through opposite sides of the outer sleeve and each slot intermediate the pair of apertures, said pair of slots configured to allow sides of the outer sleeve to flex outwardly when a forward surface of the lock tabs engage the rearward flange of the outer sleeve.

4. The female coaxial connector assembly according to claim 3, further comprising a connector housing in which the outer sleeve is received and wherein the connector housing inhibits the sides of the outer sleeve from flexing outwardly, thereby retaining the pair of lock tabs within the pair of apertures.

* * * * *